United States Patent [19]

Bianchi

[11] Patent Number: 4,554,709

[45] Date of Patent: Nov. 26, 1985

[54] CHAIN-DRIVEN COMB HEAD FOR SLIVERS OF TEXTILE FIBRES, PARTICULARLY FOR DRAWING FRAMES

[75] Inventor: Angelo Bianchi, Novara, Italy

[73] Assignee: Sant-Andrea Novara Officine Meccaniche e Fonderie S.p.A., Italy

[21] Appl. No.: 630,553

[22] Filed: Jul. 13, 1984

[51] Int. Cl.[4] ..... D01G 19/22

[52] U.S. Cl. ..... 19/218; 19/129 A

[58] Field of Search ..... 19/218, 215, 216, 217, 19/127, 129 R, 129 A, 245, 263

[56] References Cited

U.S. PATENT DOCUMENTS 4,398,319 8/1983 Viaggi ..... 19/129 R

FOREIGN PATENT DOCUMENTS 920717 9/1956 Fed. Rep. of Germany .

OTHER PUBLICATIONS

German Publication No. 3326677; Published 4–1984, Class 19, Sub. 215.

*Primary Examiner*—Louis K. Rimrodt
*Assistant Examiner*—J. L. Olds
*Attorney, Agent, or Firm*—Sughrue, Mion, Zinn, Macpeak and Seas

[57] ABSTRACT

In a chain-driven comb head for drawing frames, of the type including means for directing compressed air jets at the combs, these means comprise ducts for supplying compressed air to each needle field defined by the combs and slots for generating, from the supplied air, at least one flat jet of compressed air directed outwardly in a predetermined direction which does not intersect the zone of treatment of the sliver between the combs. During movement of the combs, the flat jet of compressed air flows successively over the surfaces of the combs to clean them. The needle-carrying bars making up the combs are rotatably mounted about their axes and have one end out of alignment, the head structure including at least two tracks engaged by the non-aligned ends and shaped so as to cause the combs to orient themselves in a predetermined direction when they pass in front of the flat jet.

2 Claims, 3 Drawing Figures

Figure 1:
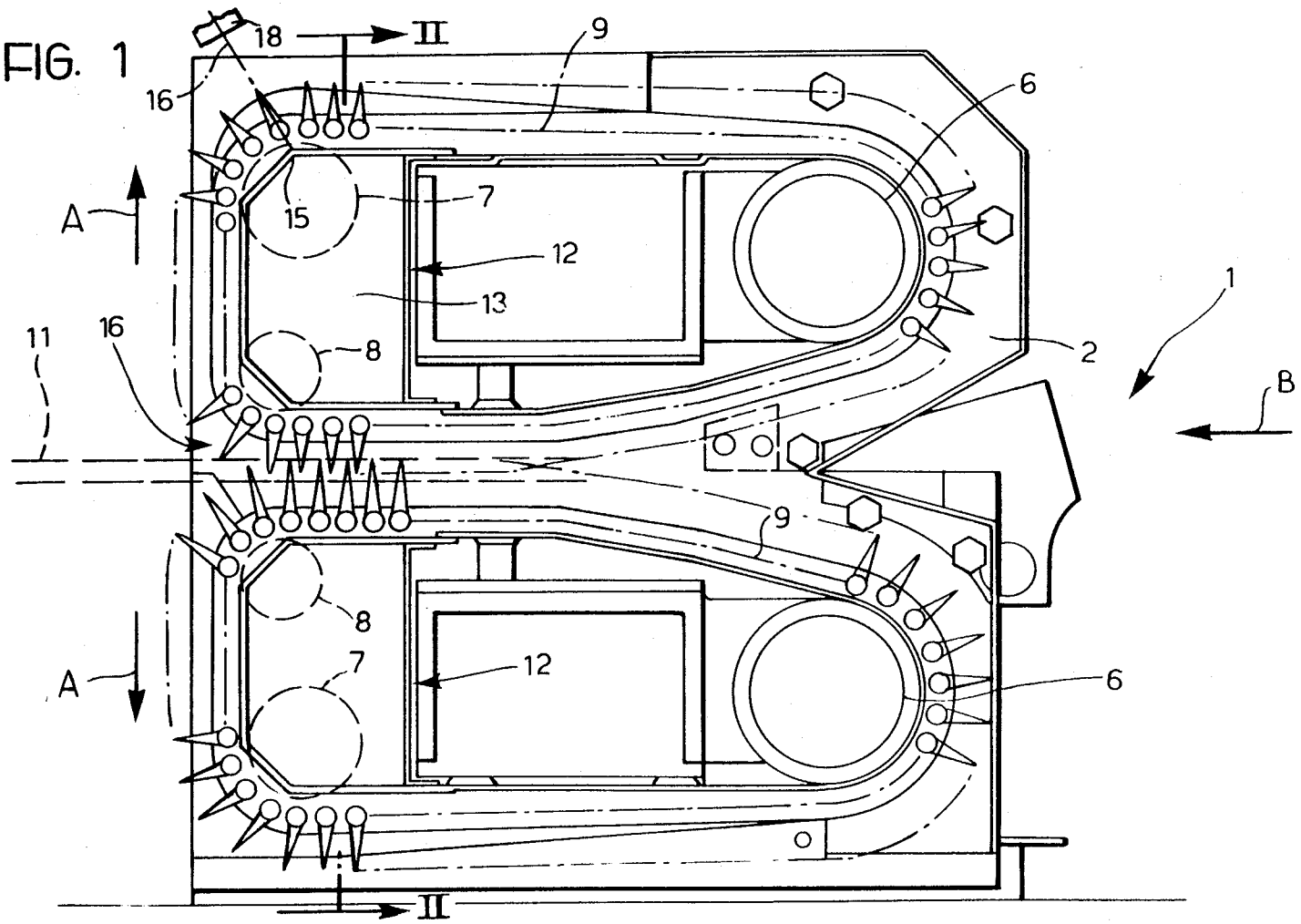

CHAIN-DRIVEN COMB HEAD FOR SLIVERS OF TEXTILE FIBRES, PARTICULARLY FOR DRAWING FRAMES

The present invention relates to chain-driven comb heads for slivers of textile fibres, particularly for drawing frames, of the type including two series of needle-carrying bars or combs driven by chains about two superimposed closed paths, the combs of the two series defining two fields of needles which intersect in a zone of treatment of the sliver of textile fibres, and means for directing compressed air jets at the combs.

A comb head of the aforesaid type is described and illustrated, for example, in German Pat. No. 920,717.

Compared with conventional machines having comb heads with intersecting needles driven by worms or screws, devices of this type have the advantage of offering a faster working rate, reduced mechanical wear and easy, limited maintenance, while giving the same working quality typical of conventional machines. In order to obtain these results, it is essential to ensure perfect cleaning of the working zone and the mechanical members of the head, particularly the combs. While the cleaning of the combs of conventional heads with screws is, in fact, achieved directly by virtue of the comb drive mechanism itself, in chain-driven heads it is necessary to provide a cleaning device for removing waste material which is deposited between the needles of the combs during working.

Chain-driven heads used until now have employed mechanical cleaning devices such as, for example, rotary brushes driven by the combs, mechanically driven rotary brushes, or rotary brushes driven mechanically and cleaned by mechanical cleaners and suction apertures. Such devices have a number of disadvantages among which may be mentioned:

difficulties of adjustment and maintaining the adjustment with time, wear and tear of the brushes and their drive members, difficulty of access to the working zone, and the geometric impossibility of cleaning the combs completely because of the prevalence of the tangential effect in the relative movement between the cleaning brushes and the needles of the combs, which results in the impossibility of removing all the waste material from the combs and blockage of material at the roots where the needles are attached to the combs.

The device illustrated in the German patent mentioned above provides for the use of apertures which direct jets of compressed air against the sliver of textile fibres at the outlet end of the working zone, in order to facilitate the detachment of the sliver from the combs. These jets are directed so as to flow over the combs as well, but this causes the disadvantage that any dirt removed from the combs by the jets of compressed air is blown towards the sliver being worked, causing dirty areas which result in defects in the subsequent working.

European patent application No. 0035977 filed by the present applicants describes and illustrates a rotary comb head of the type in which the combs are supported at their ends by two pairs of discs fixed to the ends of two contra-rotating shafts, wherein the cleaning means include means for directing compressed air into each needle field and for generating, with the compressed air supplied to the needle field, a flat jet directed outwardly in a predetermined direction such that, during rotation of the respective shaft, the flat air jet flows successively over the surfaces of the combs of the needle field. The direction of the flat jet is naturally chosen so as to avoid interference with the sliver being worked and to prevent the risk of dirt being deposited on this sliver.

The problem behind the present invention is that of applying this concept (the use of a flat jet of compressed air directed from the interior of each needle field towards the exterior) to a chain-driven comb head of the type specified at the beginning of the present description.

In the application of this concept to a head of the chain-driven type, however, several difficulties are encountered in that it is necessary, on the one hand, to avoid the combs being disposed parallel to the flat jet because this would involve a reduced cleaning action, and, on the other hand, it is also necessary to avoid the combs being steeply inclined to the jet because in this case the dirt removed from each comb would tend to be deposited on the adjacent comb.

The object of the present invention is to overcome these disadvantages.

The characteristic of the invention lies in the fact that the means for directing compressed air jets against the combs of the head include means for supplying compressed air to each needle field and means for generating, from the compressed air fed to each needle field, a flat jet of compressed air directed outwardly in a predetermined direction which does not intersect the zone of treatment of the sliver, whereby the flat jet of compressed air flows successively over the surfaces of the combs of the needle fields during movement of the combs.

in that each needle-carrying bar is rotatably mounted about its axis and has one end out of alignment, and in that the fixed structure of the comb head includes at least two shaped tracks engaged by the non-aligned ends of the needle-carrying bars of the two needle fields, the tracks being shaped so as to cause the various combs to orient themselves in a predetermined direction when they pass in front of the flat jet of compressed air.

By virtue of this characteristic, when each comb is close to the zone of the compressed air jet, it is made to rotate about its axis so as to present itself to the jet with a slight inclination thereto. This inclination is sufficiently high to avoid the risk of inefficient cleaning and sufficiently small to prevent the dirt removed from each comb being deposited on the adjacent comb.

Moreover, in order to avoid the dirt removed being deposited in the surrounding areas of falling onto the sliver being worked, the comb head according to the invention preferably has suction apertures located along the direction of the compressed air jet.

Figure 2:
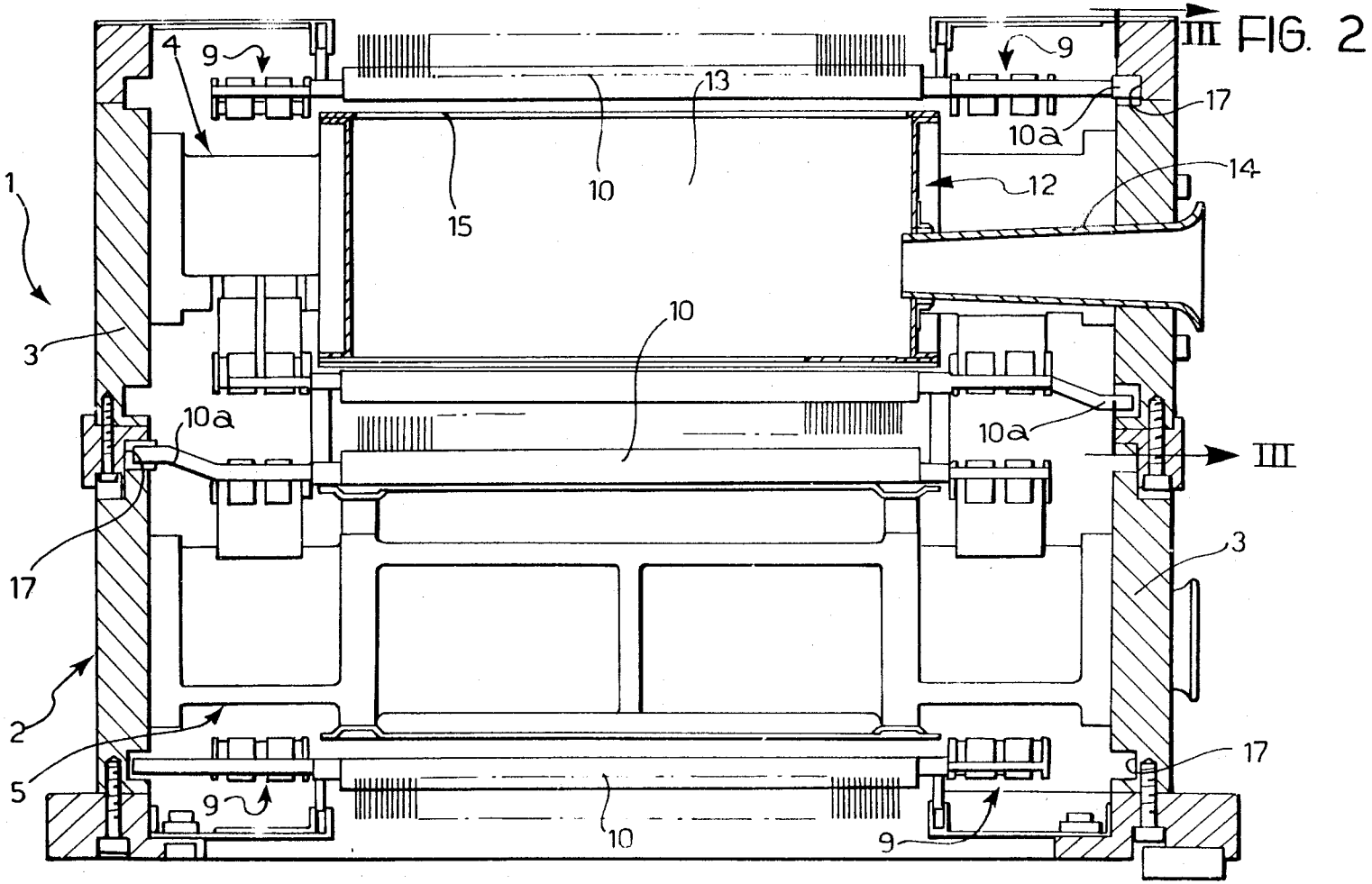
Figure 3:
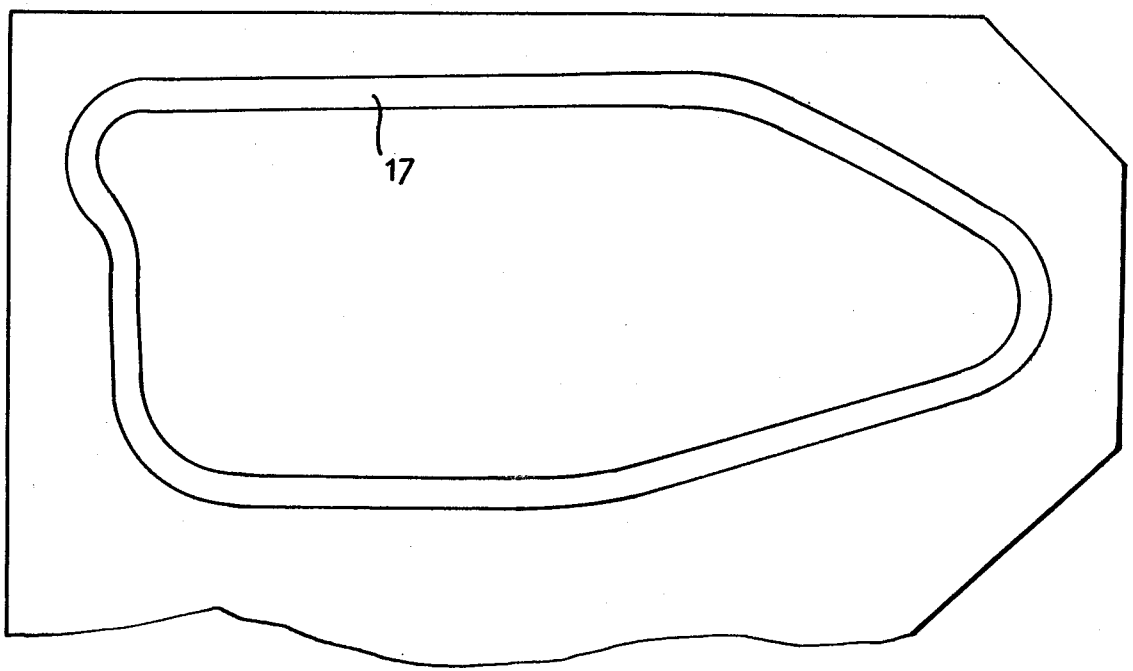

Further characteristics and advantages of the invention will become apparent from the description which follows with reference to the appended drawings, provided purely by way of non-limiting example, in which:

FIG. 1 is a section of the head according to the invention, taken in a vertical plane, FIG. 2 is a section taken on the line II—II of FIG. 1, and FIG. 3 illustrates schematically a detail of the head according to the invention.

In FIGS. 1 and 2, a chain-driven comb head for drawing slivers of textile fibres is generally indicated 1.

The head 1 has a fixed structure 2 which includes two sides 3 joined by two spaced-apart superimposed support structures 4, 5.

Each support structure 4, 5 supports two series of gear wheels 6, 7, 8 (see FIG. 1) on which are mounted two pairs of chains 9. The gear wheels 6, 7, 8 are not illustrated in FIG. 2 for reasons of clarity.

The ends of two series of needle-carrying bars or combs 10 are fixed to the chains 9.

With reference to FIG. 1, the chains 9 drive the two series of needle-carrying bars 10 about two superimposed closed paths, the combs of the two series defining two needle fields which intersect in a zone of treatment of the sliver of textile fibres (illustrated in broken outline in FIG. 1 and indicated by reference numeral 11). The two series of combs 10 move in the direction indicated by the arrows A in FIG. 1, the direction of movement of the sliver of textile fibres being indicated by the arrow B.

Each support structure 4, 5 includes a box structure 12 defining a chamber 13. This chamber communicates with the exterior through a duct 14 for the supply of compressed air to the chamber 13. The wall of each member 12 further includes a slot 15 located on the opposite side from the working zone 16 and intended to direct the compressed air supplied to the chamber 13 through the duct 14 outwardly in the form of a flat jet 16, so as to enable the cleaning of the combs which pass successively in front of it during the operation of the head.

As illustrated in FIG. 2, the needle-carrying bars 10 are rotatable about their axes and each have one non-aligned end 10*a*. The ends 10*a* of each series of combs are guided in a shaped track 17 formed in one side 3 of the machine (two of these tracks being associated respectively with the two series of combs and being located on opposite sides).

FIG. 3 illustrates the shape of a track 17.

As a result of the engagement of the ends 10*a* of the combs 10 in the tracks 17, each comb rotates about its own axis when it approaches the zone of the compressed air jet 16, so as to assume a predetermined inclination to this jet when it is hit thereby. This inclination must be sufficient to prevent the jet flowing over the comb without having an effective cleaning action and, at the same time, must not be so excessive that the adjacent combs would be partially superimposed in the direction of the jet whereby the dirt removed from each comb would be deposited on the adjacent comb.

The means for supplying the compressed air to the ducts 14 are not shown in the drawings because they are of known type.

Preferably, a suction aperture 18 is provided along the direction of the compressed air jet 16 for collecting the dirt so as to prevent the risk of this being deposited in the surrounding zones or falling into the sliver during working.

Naturally, the present invention also applies to other models which achieve equal utility by using the same innovative concept.

What is claimed is:

1. A chain-driven comb head for slivers of textile fibres, particularly for drawing frames, of the type comprising a fixed structure, two series of combs formed by needle-carrying bars and defining two needle fields which intersect in a zone of treatment of the sliver, chains for driving said combs about two superimposed closed paths, and means for directing compressed air jets at said combs, wherein the improvements consist in:

said means for directing compressed air jets against the combs including means for supplying compressed air to each needle field and means for generating, from the compressed air fed into each needle field, at least one flat jet of compressed air directed outwardly in a predetermined direction which does not intersect said zone of treatment, whereby said flat jet flows successively over the surfaces of the combs of said needle fields during movement of said combs;

each said needle-carrying bar being rotatably mounted about its axis and having one end out of alignment, and said fixed structure of the head including at least two shaped tracks engaged by said non-aligned ends of the needle-carrying bars, said tracks being shaped so as to cause said combs to orient themselves in a predetermined direction when they pass in front of said first jet.

2. A comb head as defined in claim 1, wherein a suction aperture is provided along the direction of said compressed air jet to collect material removed from the combs.

* * * * *

UNITED STATES PATENT OFFICE

CERTIFICATE OF CORRECTION

Patent No. 4,554,709 Dated November 26, 1985

Inventor(s) Angelo BIANCHI

It is certified that error appears in the above-identified patent and that said Letters Patent are hereby corrected as shown below:

On the Title Page add:

[30] Foreign Application Priority Data

September 12, 1983 Italy 53707-B/83

Signed and Sealed this

Seventh Day of April, 1987

*Attest:*

DONALD J. QUIGG

*Attesting Officer*

*Commissioner of Patents and Trademarks*